United States Patent [19]

Suck et al.

[11] Patent Number: 4,809,888

[45] Date of Patent: Mar. 7, 1989

[54] METERING VALVE

[75] Inventors: Catherine Suck, Sceaux; Pierre Bret, Annemasse; Jacques Pozzi, Meudon, all of France

[73] Assignee: Societe de Promotion, Recherche et Innovation Technologique, France

[21] Appl. No.: 607,255

[22] Filed: May 4, 1984

[30] Foreign Application Priority Data

May 5, 1983 [FR] France ..... 83 07508

[51] Int. Cl.[4] ..... B65D 83/00; E03B 3/00

[52] U.S. Cl. ..... 222/402.11; 222/402.2; 222/453; 137/625.68

[58] Field of Search ..... 222/402.1, 402.11, 402.2, 222/153, 207, 453, 476; 137/625.68

[56] References Cited

U.S. PATENT DOCUMENTS

| | | | |
|---|---|---|---|
| 2,706,660 | 4/1955 | Johnson | 222/402.11 |
| 3,325,054 | 6/1967 | Braun | 222/153 X |
| 3,360,168 | 12/1967 | Bret | 222/402.2 X |
| 3,545,479 | 12/1970 | Loe | 137/625.68 X |
| 3,858,771 | 1/1975 | Bret et al. | 222/402.2 |

*Primary Examiner*—Joseph J. Rolla
*Assistant Examiner*—Gregory L. Huson
*Attorney, Agent, or Firm*—Darby & Darby

[57] ABSTRACT

A metering valve adapted to be mounted on a container for delivering a liquid under pressure contained in the container, of the type comprising a metering head with an elastic membrane, an end-sleeve, a valve body and a piston sliding in the valve body and formed with a blind central bore and a radial throughgoing hole opening into the central bore. The valve body is made of two portions, a lower portion positioned to be located inside the container when the valve is mounted on the container and an upper portion applied on the lower portion positioned to be inside the container, but extending outside the container on a major portion thereof when the valve is so mounted. The upper portion of the valve body is formed with a bore in which slides a piston limited upwardly by a shoulder forming an abutment for the piston. The piston is formed with an outer annular groove in its central portion surrounded by two O-rings. The radial throughgoing hole of the piston opens into the annular groove.

3 Claims, 3 Drawing Sheets

METERING VALVE

Figure 1:
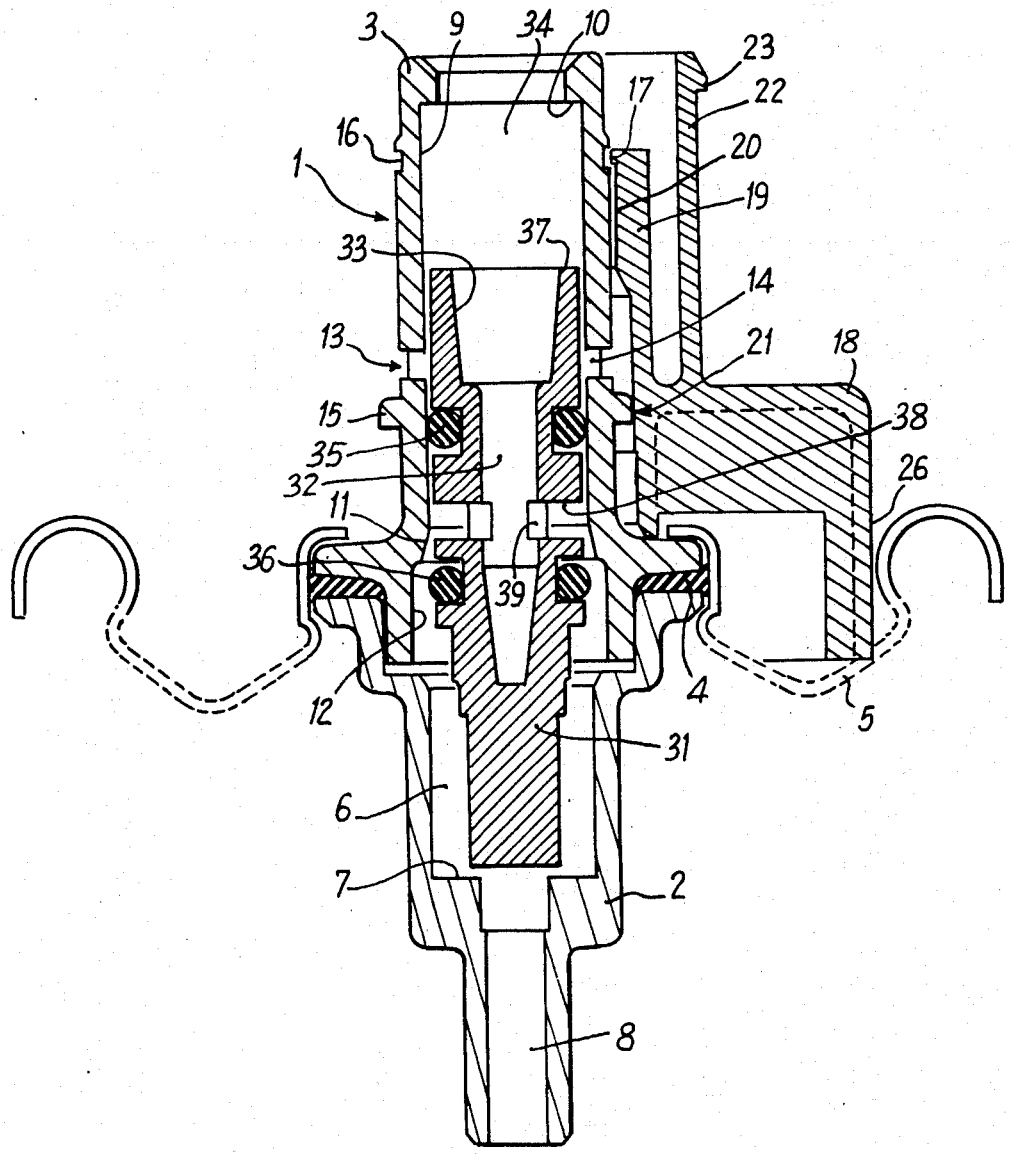

This invention relates to a metering valve, viz. a metering device with an automatic closing for delivering in the form of aerosols liquids contained under pressure in containers.

From FR-A No. 1 568 205 is known how to fix a valve body on the opening of a container, by means of a cupel crimped on the opening, to cover said cupel by a cap formed with a passage from an axial chamber to a spraying nozzle and how to dispose, on the axial piston extending from the valve body, a metering head formed of a rigid volume. The axial piston is biased upwardly by a spring housed in the valve body. It includes a blind central bore and a radial throughgoing hole. When the piston is depressed under a pressure exerted on the valve body, the hole sets in communication the inside of the container with the inside of the valve head. When the piston is returned upwardly by the spring, the hole sets in communication the inside of the valve head and the passage provided in the cap for spraying the liquid.

Such a valve has various disadvantages and notably the fact that it is the cap which provides the tightness between the piston and the cupel and valve body assembly. Moveover, the inner volume of the valve head is full of air, and when some liquid is withdrawn from the container by a pressure applied on the valve head, the liquid under pressure fills the valve head by compressing the air therein. After a few withdrawals, the inner pressure in the container tends to decrease and, by way of consequence, the quantity withdrawn also tends to decrease.

Moreover, the guiding of the piston is only ensured over a small length of the cap, whereby the valve head has a tendency to lean when being handled and the result is a clearance which is detrimental to the tightness. Finally the valve head can be subjected to an accidental pressure and promote an unwanted spraying without any possibility of avoiding such a disadvantage, if placed in a case or bag for example.

One of the objects of the present invention is to provide a metering valve of simple realization, of reduced size, easy to use and of a low cost price, meaning a metering valve the designing of which allows avoiding the disadvantages of the known metering valves.

An other object of the invention is to provide a valve the dead volumes of which are reduced so as to increase the metering accuracy.

The present invention is directed to a metering valve for delivering a liquid under pressure contained in a container, of the type comprising a metering head with an elastic membrane, an end-sleeve, a valve body and a piston sliding in the valve body and formed with a blind central bore and radial throughgoing hole opening into said central bore, characterized in that:

- the valve body is made of two portions, a lower portion located inside the container and an upper portion applied on the lower portion inside the container, but extending outside the container on a major portion thereof;
- said upper portion of the valve body is formed with a bore in which slides the piston, limited upwardly by a shoulder forming an abutment for the piston;
- the piston is formed with an outer annular groove in its central portion surrounded by two O-rings;
- said radial throughgoing hole of the piston opens into said annular groove.

According to other features of the invention:

- the upper portion of the valve body is formed with an outer annular groove, at least a passage between said groove and a bore for the ejection of the metered liquid, said outer annular groove of the piston being in register with said annular groove of the valve body when the piston is in a high position, bearing against the shoulder;
- the end-sleeve which covers the valve body is put in position by snapping in a rib in an annular slot of the valve body, without any particular orientation;
- the metering head has a skirt provided with a lower semi-circular notch to be placed above the end-piece for authorizing the downward movement of the metering head for its normal operation, and in any other position for preventing the valve being operated.

Figure 2:
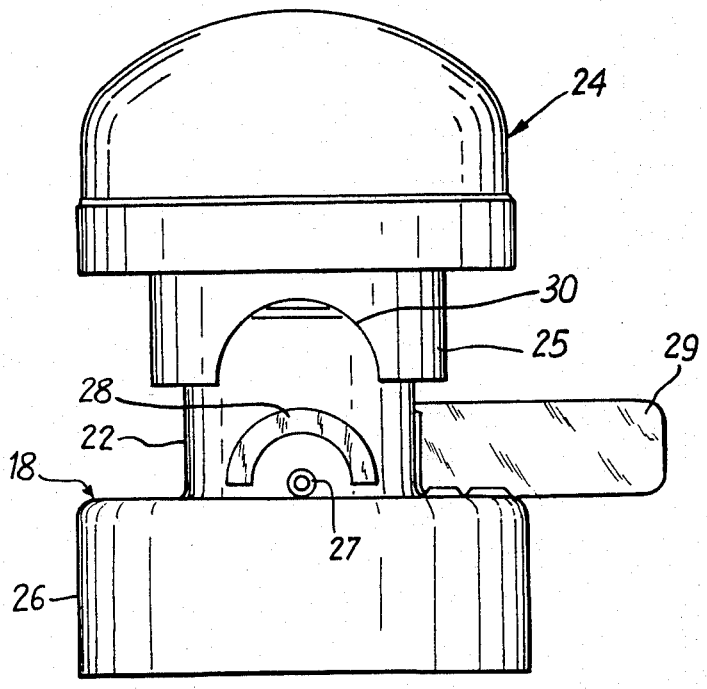
Figure 3:
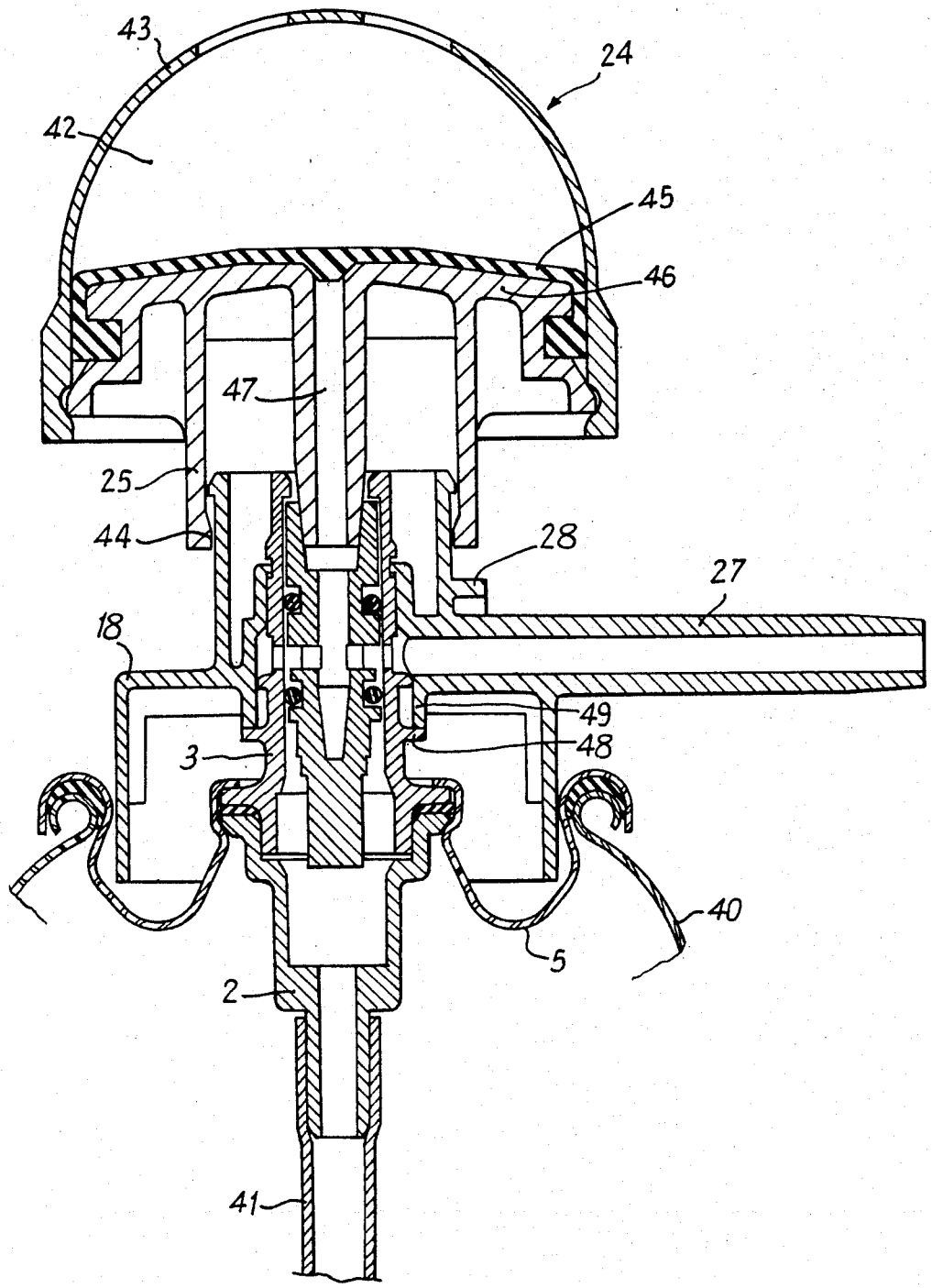

Further features will become apparent from the following description, with reference to the accompanying drawings wherein:

FIG. 1 is a partial longitudinal sectional view of an embodiment of a metering valve according to the invention, limited to the valve body with its piston and a portion of the end-sleeve, FIG. 2 is a view from the outside of the end-sleeve and of the valve body according to the invention, FIG. 3 is a general sectional view of a particular embodiment of the metering valve according to the invention.

Referring to the drawing, one sees (FIG. 1) that the valve body 1 is formed of a lower portion 2 and of an upper portion 3 fitting into each other, the tightness being provided for example by a rubber ring 4. A flexible metal collar 5 can be used for maintaining the assembly and for fixing it in position on the neck of a flask 40 for example.

The lower portion 2 is formed with a central well 6 limited by an inner shoulder 7, and a lower axial channel 8 which can be connected by being fitted into a plunger tube 41 (FIG. 3) the function of which is to have the liquid under pressure rising upwardly to the valve.

The upper portion 3 is formed with a central bore 9 limited at the top by a shoulder 10. In its lower portion said bore 9 flares out at 11 for joining a wider lower bore 12 which is directly in register with the central well 6 of the lower portion. About half-way along its height, the upper portion 3 is formed with an outer annular groove 13 provided with at least one radial passage 14, and preferably two radial passages diametrically opposite. Said groove 13 is bordered underneath by a circular rib 15.

In the vicinity of its upper end, the upper portion of the valve body 1 is formed with an annular slot 16 for receiving an inner circular rib 17 of the end-sleeve 18 which caps the valve body 1. Said end-sleeve includes a substantially cylindrical inner ring 19, carrying rib 17 on its upper portion. It bears against the upper portion 3 of valve body on the one hand, in its upper portion, via a first cylindrical region 20, and on the other hand in the vicinity of its middle portion and against the circular rib 15 of the valve body via a second cylindrical region 21 of larger diameter than the first region 20.

The end-sleeve 18 includes also an outer cylindrical ring 22, coaxial with the inner ring 19, and provided at its upper edge with an outer rib 23 for retaining sleeve 25 on the valve head 24 (FIG. 2). The end-sleeve includes a cylindrical skirt 26 covering the median portion of the valve body, having a diameter notably larger than the rings 19 and 22 and coming to rest by its lower free edge on the flask or on collar 5 for example.

The end-sleeve includes a radial connector 27 at the level of annular groove 13 of the valve body when the end-sleeve is in position, and which extends through rings 19 and 22. Said connector is a tube for providing the exhaust to the outside of the metered liquid. It can receive a prolongation or diffusor, not shown. Said connector is topped by a bossing 28 of cylindrical shape, protruding above the connector and parallel therewith. The length of the connector is for example of 1 cm about and that of the bossing of a few millimeters about. According to some embodiments, bossing 28 can be made of the connector 27 itself, when the size of the latter is sufficient. Finally, the end-sleeve carries a safety tong 29 for preventing any operation of the valve prior to being put in service, and adapted for being removed by breaking its articulation points on the end-sleeve 18.

The metering head 24 which is placed above the end-sleeve 18 is substantially made of a cavity 42, the volume of which corresponds to the quantity of liquid required. This cavity is entirely housed inside a rigid envelope 43 rounded at the upper portion of the head. Said rounded envelope is used as a bearing point for the operator who wants to operate the valve.

The metering head 24 (FIG. 3) is provided with a resilient membrane 45, normally resting on the floor 46 of the metering head, and adapted for being applied under the rigid envelope 43 when the metering head is being filled with liquid under pressure. Under cavity 42 is provided a cylindrical skirt 25 having a substantially semi-circular notch 30. The lower edge of skirt 25 comprises toward the inside a circular rib 44. Said rib is ment to retain the metering head in position on the end-sleeve. To this effect, the metering head is put in position due to a resilient deformation of skirt 25, the inner rib of skirt 25 passing beyond the outer rib 23 of ring 22 and remaining in abutment underneath said rib 23.

When the metering head 24 is moved downwardly, notch 30 surrounds bossing 28 and, at the limit, bears against it, thereby limiting the downward movement of the valve head.

According to the invention, valve head 24 assumes any orientation relative to the end-sleeve. Before putting the valve in service, which is the case of FIG. 2, the position of notch 30 relative to bossing 28 is non critical since the safety tong 29 prevents the head from moving down. However, if notch 30 is just above tong 29, the latter cannot prevent the downward movement of the head. In that case, the lower edge of skirt 25 comes in abutment against bossing 28, thereby preventing the downward movement of the valve head.

After setting the valve in service by tearing away tong 29, notch 30 which is just above bossing 28 allows operating the valve by moving head 24 downwardly. If it is required to avoid the accidental operation of the valve, during a transportion for example, the only thing to do is to turn the metering head so that the edge of skirt 25 is bossing 28.

The metering head 24 is formed in its axis with a channel 47 (FIG. 3) for cooperating with the piston 31 of the valve. This channel is a tube opening under membrane 45 and communicating the cavity contained inside metering head 24 with the axial bore of piston 31 of the valve. To this effect, the axial bore 32 of the piston includes in its upper portion a flared out portion 33 (FIG. 1) opening upwardly and adapted for receiving the axial channel 47 of the metering head 24, the lower end of which is thereby guided when mounting the assembly. The axial bore 32 is blind. Piston 31 can move within a piston chamber 34 formed by the inner volume of valve body 1, that is the well 6 for the lower portion 2 of valve body and the volume defined by bores 9 and 12 and the conical flared portion 11 for the upper portion 3. Piston 31 comprises two outer annular slots for receiving O-rings 35 and 36 defining therebetween a central region separating an upper region and a lower region. The lower region is without throughgoing hole and tapers downwardly for eventually mounting a spring thereon. The upper region is cyindrical and extends to the upper edge 37 which can come in abutment under shoulder 10. It is formed with no radial throughgoing hole. The central region is also cylindrical as the upper region. In this central region, piston 31 is formed with an outer annular groove 38. At least one radial throughgoing hole 39, and preferably two of them, communicate the annular groove 38 with the blind axial bore 32.

The O-rings 35 and 36 provide the tightness in bore 9. When the piston moves down under the action of the metering head, seal 36 passes beyond the conical enlarged portion 11 and does ensure any more the tightness, thereby allowing the liquid moving upwardly in well 6 to flow past seal 36, outwardly thereof, into the annular groove 38, the throughgoing holes 39 and the blind bore 32, and from there to move upwardly in the axial channel of the well and to fill up the metering cavity, by pushing back the resilient membrane 45 against the rigid envelope 43.

If one releases the metering head 44, the pressure prevailing in the flask and well 6 promotes the upward movement of piston 31 which pushes back the metering head 24 upwardly. During this upward movement, seal 36 slides again in bore 9 and isolates tightly groove 38. When said groove 38 comes in register with the annular groove 13 of the valve body, the liquid contained in the metering head 24 can flow out under the action of the resilient membrane 45. Due to the presence of said two annular grooves 38 and 13, the liquid under pressure is conveyed to the end-piece 27 and from there to the outside, without any relative orientation having to be respected between valve body 1, piston 31, end-sleeve 18 and head 24. However, one should not that piston 31 and metering head 24 are rigidly connected to each other by the axial channel 47 of the metering head, whereby the assembly can pivot relative to the end-sleeve 18 and to the valve body 20. In the position corresponding to the ejection of the liquid under pressure, piston 31 is bearing by its upper edge 37 under shoulder 10 which limits its stroke upwardly.

In FIG. 3, one can see that the end-sleeve 18 does not bear, as in the case of FIG. 1, on the flask or on the collar 5 for example, via its lower free edge.

In the particular embodiment shown in FIG. 3, the upper portion 3 of the valve body comprises a protruding rib 48 on which comes to bear the inner cylindrical portion 49 of the end-sleeve. In this embodiment, one can point out that it is the valve body which supports all the other elements. Since there does not exist any other bearing points for such elements, the connection of such various elements to each other is not impeded and their mutual cohesion is improved.

One can remark that the metering valve according to the invention offers many advantages as compared to the prior art metering valves. First of all, there is no orientation to be respected for the piston, the valve body, the end-sleeve and the metering head when mounting the assembly. Therefore, the assembly of the valve can be carried out in an automated manner.

Moreover, the simplification of the piston geometry allows reducing the size of the piston and the valve, thereby reducing the cost of raw materials. On the other hand, the arrangements of a bossing above the end-piece and of a notch in the skirt of the valve head allows reducing the height of the assembly and provides a safety position for the metering head by merely rotating it. Since piston 31 has no specific orientation, metering head 24 can rotate relative to the end-sleeve 18, and the snap-in fixation of the metering head on the end-sleeve is possible.

Morever, it should be pointed out that the size reduction of the valve brings about a reduction of the dead volumes and consequently an improvement of the metering accuracy.

Finally, it should be remarked that the upper portion 3 of the valve body provides an efficient guiding for piston 31 over a large stroke. Therefore, the movement of metering head 24 is also well guided. Since the tightness is provided by O-rings moving in the valve body, there is practically no risk of leakage.

We claim:

1. A metering valve adapted to be mounted on a container for delivering a liquid under pressure contained in the container, of the type comprising a metering head with an elastic membrance, an end-sleeve, a valve body and a piston sliding in the valve body and formed with a blind central bore and a radial throughgoing hole opening into said central bore, characterized in that:

the valve body is made of two portions, a lower portion positioned to be located inside the container when the valve is mounted on the container and an upper portion applied on the lower portion positioned to be inside the container, but extending outside the container on a major portoin thereof when the valve is so mounted;

said upper portion of the valve body is formed with a bore in which slides a piston limited upwardly by a shoulder forming an abutment for the piston;

the piston is formed with an outer annular groove in its central portion surrounded by two O-rings;

said radial throughgoing hole of the piston opens into said annular groove; the upper portion of the valve body is formed with an outer annular groove, at least a passage between said groove and the bore for the ejection of the metered liquid, said outer annular groove of the piston being in register with said annular groove of the valve body when the piston is in a high position, bearing against the shoulder.

2. A metering valve adapted to be mounted on a container for delivering a liquid under pressure contained in the container, of the type comprising a metering head with an elastic membrane, and end-sleeve, a valve body and a piston sliding in the valve body and formed with a blind central bore and a radial throughgoing hole opening into said central bore, characterized in that:

the valve body is made of two portions, a lower portion positioned to be located inside the container when the valve is mounted on the container and an upper portion applied on the lower portion posittoned to be inside the container, but extending outside the container on a major portion thereof when the valve is so mounted;

said upper portoin of the valve body is formed with a bore in which slides a piston limited upwardly by a shoulder forming an abutment for the piston;

the piston is formed with an outer annular groove in its central portion surrounded by two O-rings;

said radial throughgoing hole of the piston opens into said annular groove; the end sleeve which covers the valve body is put in position by snapping in a rib in an annular slot of the valve body, without any particular orientation.

3. A metering valve according to claim 2, wherein the upper body is provide with an end piece on its outer periphery and the metering head has a skirt provided with a lower semi-circular notch to be placed above the end-piece for authorizing the downward movement of the metering head for its normal operation, and in any other position for preventing the valve being operated.

* * * * *